United States Patent [19]

Carlson et al.

[11] 4,100,057

[45] Jul. 11, 1978

[54] METHOD OF TREATING A SOUR PETROLEUM DISTILLATE

[75] Inventors: David H. J. Carlson, Park Ridge; James R. Deering, Prospect Heights, both of Ill.

[73] Assignee: UOP Inc., Des Plaines, Ill.

[21] Appl. No.: 820,472

[22] Filed: Aug. 1, 1977

[51] Int. Cl.[2] ..... C10G 27/06

[52] U.S. Cl. ..... 208/206

[58] Field of Search ..... 208/206, 207, 204; 252/431 N

[56] References Cited

U.S. PATENT DOCUMENTS

| | | | |
|---|---|---|---|
| 2,983,674 | 5/1961 | Bauer | 208/206 |
| 3,097,158 | 7/1963 | Gleim | 208/206 |
| 3,408,287 | 10/1968 | Urban et al. | 208/207 |

*Primary Examiner*—George Crasanakis

*Attorney, Agent, or Firm*—James R. Hoatson, Jr.; Robert W. Welch; William H. Page, II

[57] ABSTRACT

An improved method of treating a sour petroleum distillate is disclosed. Morpholine is admixed with the sour distillate and the distillate thereafter contacted with a metal phthalocyanine catalyst in the presence of an oxidizing agent at alkaline reaction conditions.

10 Claims, No Drawings

METHOD OF TREATING A SOUR PETROLEUM DISTILLATE

This invention relates to an improved method of treating a sour petroleum distillate. Processes for the treatment of sour petroleum distillates wherein the distillate is contacted with a metal phthalocyanine catalyst in the presence of an oxidizing agent at alkaline reaction conditions have become well known and widely practiced in the petroleum refining industry. Said processes are typically designed to effect the oxidation of offensive mercaptans contained in a sour petroleum distillate with the formation of innocuous disulfides—a process commonly referred to as sweetening.

The sweetening process has heretofore been effected in a liquid-liquid treating system wherein the sour petroleum distillate is treated in contact with an oxidizing agent, usually air, and an aqueous caustic dispersion of the metal phthalocyanine catalyst. In this type of operation, mercaptans are converted to disulfides at the interface of the immiscible hydrocarbon and water phases. More recently, the sweetening process has been effected in a fixed bed type of operation wherein the metal phthalocyanine catalyst is employed adsorbed or impregnated on a solid adsorbent support or carrier material disposed as a fixed bed in a treating or contacting vessel, the sour petroleum distillate being passed in contact with the supported catalyst in the presence of an oxidizing agent and an aqueous caustic solution. In the latter case, the sour petroleum distillate is treated in contact with an oxidizing agent and the supported metal phthalocyanine catalyst, the supported catalyst being wetted with an aqueous caustic solution charged to the process continuously or intermittently as required.

It is an object of this invention to present an improved method of treating a sour petroleum distillate.

Thus, in one of its broad aspects, the present invention embodies a novel method of treating a sour petroleum distillate which comprises admixing from about 5 to about 50 wt. ppm morpholine with said distillate, and thereafter treating the distillate in an alkaline environment in contact with an oxidizing agent and a metal phthalocyanine catalyst.

One of the more specific embodiments concers a method of treating a sour petroleum distillate which comprises admixing from about 5 to about 50 wt. ppm morpholine with said distillate, and thereafter treating the distillate in an alkaline environment in contact with air and a cobalt phthalocyanine catalyst.

Another of the more specific embodiments relates to a method of treating a sour petroleum distillate which comprises admixing from about 5 to 25 wt. ppm morpholine with said distillate and thereafter treating the distillate in an aqueous caustic environment in contact with air and an activated charcoal-supported cobalt phthalocyanine catalyst.

Other objects and embodiments of this invention will become apparent in the following detailed specification.

Pursuant to the present invention, the sour petroleum distillate to be treated is first admixed with morpholine (tetrahydro-1, 4-oxazine). Morpholine, heretofore recognized as an effective corrosion inhibitor, has now been found to be a surprisingly effective promoter for the metal phthalocyanine-catalyzed oxidation of mercaptans contained in a sour petroleum distillate. A preferred concentration of morpholine in the sour petroleum distillate is in the range of from about 5 to about 50 wt. ppm. Larger concentrations tend to become less effective. A morpholine concentration of from about 5 to about 25 wt. ppm is most preferred.

The present invention can be practiced utilizing the described liquid-liquid treating process or the described fixed bed treating process. In either case, the treating process can be effected in accordance with prior art treating conditions. The process is usually effected at ambient temperature conditions, although higher temperatures up to about 150° C are suitably employed. Pressures of up to about 1000 psi or more are operable, although atmospheric or substantially atmospheric pressures are entirely suitable. Contact times equivalent to a liquid hourly space velocity of from about 1 to about 100 or more are effective to achieve a desired reduction in the mercaptan content of a sour petroleum distillate, an optimum contact time being dependent on the size of the treating zone, the quantity of catalyst contained therein, and the character of the distillate being treated.

As heretofore mentioned, the sweetening process involves the oxidation of mercaptans contained in a sour petroleum distillate with the formation of innocuous disulfides. This oxidation reaction is effected in an alkaline environment created, for example, by admixing an aqueous caustic solution with the sour petroleum distillate treated in a fixed bed treating process or, for example, by contacting the sour distillate with the metal phthalocyanine catalyst dispersed in an aqueous caustic solution when the distillate is treated in accordance with the liquid-liquid treating process. Other suitable alkaline solutions particularly include aqueous potassium hydroxide solutions, but also aqueous solutions of lithium hydroxide, rubidium hydroxide and cesium hydroxide. Similarly, while water is a preferred solvent for the alkaline reagent, other solvents may be employed, including, for example, alcohols, and especially methanol, ethanol, propanol, butanol, etc., and ketones including acetone, methylethyl ketone, etc. In some cases, the treating is effected in the presence of both an aqueous solution of the alkaline reagent and an alcohol, particularly methanol or ethanol, or solutizers or solubilizers including, for example, phenols, cresols, butyric acid, etc.

The metal phthalocyanines employed to catalyze the oxidation of mercaptans contained in a sour petroleum distillate generally include magnesium phthalocyanine, titanium phthalocyanine, hafnium phthalocyanine, vanadium phthalocyanine, tantalum phthalocyanine, molybdenum phthalocyanine, manganese phthalocyanine, iron phthalocyanine, cobalt phthalocyanine, nickel phthalocyanine, platinum phthalocyanine, palladium phthalocyanine, copper phthalocyanine, silver phthalocyanine, zinc phthalocyanine, tin phthalocyanine, and the like. Cobalt phthalocyanine and vanadium phthalocyanine are particularly preferred. the metal phthalocyanine is most frequently employed as a derivative thereof, the commercially available sulfonated derivatives, for example, cobalt phthalocyanine monosulfonate, cobalt phthalocyanine disulfonate, or mixtures thereof, being particularly preferred. The sulfonated derivatives may be prepared, for example, by recting cobalt, vanadium or other metal phthalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine.

For use in the fixed bed treating operation, the metal phthalocyanine, is readily adsorbed or impregnated on a solid adsorbent support or carrier material including any of the well-known solid adsorbent materials generally utilized as a catalyst support. Preferred adsorbent materials include the various charcoals produced by the destructive distillation of wood, peat, lignite, nut shells, bones, and other carbonaceous matter, and preferably such charcoals as had been heat treated, or chemically treated, or both, to form a highly porous particle structure of increased adsorbent capacity and generally defined as activated charcoal. Said adsorbent materials also include the naturally occurring clays and silicates, for example, diatomaceous earth, fuller's earth, kieselguhr, attapulgus clay, feldspar, montmorillonite, halloysite, kaolin, and the like, and also the naturally occurring or synthetically prepared refractory inorganic oxides such as alumina, silica, zirconia, thoria, boria, etc., or combinations thereof like silica-alumina, silica-zirconia, alumina-zirconia, etc. Any particular solid adsorbent material is selected with regard to its stability under conditions of its intended use. For example, in the treatment of a sour petroleum distillate heretofore described, the solid adsorbent carrier material should be insoluble in, and otherwise inert to, the hereinafter described aqueous caustic solution and the petroleum distillate at conditions existing in the treating zone. In the latter case, charcoal, and particularly activated charcoal; is preferred because of its capacity for metal phthalocyanine, and because of its stability under treating conditions.

Mercaptan-containing gasoline, including natural, straight run and cracked gasoline, is the most frequently treated sour petroleum distillate. Other sour petroleum distillates which can be treated by the method of this invention include the normally gaseous petroleum fractions as well as naphtha, kerosine, jet fuel, fuel oil, lube oil, and the like.

The following examples are presented in illustration of the improvement derived from the practice of the present invention. The examples are not intended as an undue limitation of the generally broad scope of the invention as set out in the appended claims.

EXAMPLE I

A mercaptan-containing isooctane was treated in an alkaline environment in contact with air and a metal phthalocyanine catalyst. The morpholine promoter of this invention was not utilized. Thus, 100 ml portions of isooctane containing 1000 wt ppm t-dodecyl mercaptan sulfur were placed in four 500 ml Erlenmeyer flasks together with 5 ml of $10^0$Be caustic solution and 13.3 cc of activated charcoal-supported cobalt phthalocyanine monosulfanate. The supported catalyst comprised 12 × 30 mesh charcoal containing 150 mg of cobalt phthalocyanine per 100 cc. The flasks were stoppered and shaken mechanically for 120 minutes at ambient temperature conditions. Samples were extracted periodically and analyzed for mercaptan sulfur. The analytical data is set out in Table I below together with data from the subsequent morpholine-containing examples.

EXAMPLE II

The shaking test was repeated substantially as described except that morpholine was first admixed with the mercaptan-containing isooctane. The first repeated shake test included 5 wt ppm morpholine admixed with the mercaptan-containing isooctane. Each succeeding shake test included 25, 50, 100 and 500 wt ppm morpholine, respectively. The analytical data from each test is set out in Table I below for ready comparison with the data from Example I.

TABLE I

| Morpholine, wt. ppm | Shaking Time, Min. 0 | 30 | 60 | 90 | 20 |
|---|---|---|---|---|---|
| | Mercaptan Sulfur, wt. ppm | | | | |
| 0 | 1000 | 175 | 57 | 27 | 22 |
| 5 | 1000 | 60 | 38 | 19 | 9 |
| 25 | 1000 | 110 | 36 | 17 | 10 |
| 50 | 1000 | 210 | 31 | 19 | 14 |
| 100 | 1000 | 167 | 108 | 114 | 55 |
| 500 | 1000 | 257 | 117 | 99 | 109 |

The analytical data set out above clearly demonstrates the improvement in mercaptan sulfur conversion resulting from the practice of this invention. In particular, the criticality of the mprpholine concentration becomes readily apparent.

We claim as our invention:

1. A method of treating a sour petroleum distillate which comprises admixing from about 5 to about 50 wt ppm morpholine with said distillate and treating the distillate and morpholine mixture in an alkaline solution in contact with an oxidizing agent and a metal phthalocyanine catalyst.

2. The method of claim 1 further characterized in that said catalyst is a supported metal phthalocyanine catalyst.

3. The method of claim 1 further characterized in that said catalyst is an activated charcoal-supported metal phthalocyanine catalyst.

4. The method of claim 1 further characterized in that said metal phthalocyanine is a vanadium phthalocyanine.

5. The method of claim 1 further characterized in that said metal phthalocyanine is a cobalt phthalocyanine.

6. The method of claim 1 further characterized in that said metal phthalocyanine is a sulfonated derivative of cobalt phthalocyanine.

7. The method of claim 1 further characterized in that said metal phthalocyanine is cobalt phthalocyanine disulfonate.

8. The method of claim 1 further characterized in that said catalyst is an activated charcoal-supported cobalt phthalocyanine disulfonate comprising from about 0.1 to about 10 wt % cobalt phthalocyanine disulfonate.

9. The method of claim 1 further characterized in that said distillate is admixed with from about 5 to about 25 wt ppm morpholine.

10. The method of claim 1 further characterized in that said alkaline solution is provided by an aqueous caustic solution.

* * * * *